United States Patent [19]

Bizik et al.

[11] 4,190,017

[45] Feb. 26, 1980

[54] TANK FURNACE FOR HOT-DIP METAL COATING

[76] Inventors: Nikolai K. Bizik, ulitsa Geroev Sevastopolya, 23, kv. 6; Isidor I. Frumin, ulitsa Bolshaya Zhitomirskaya, 17, kv.6; Vladimir P. Sotchenko, ulitsa P. Tychiny, 13, kv. 210; Valery F. Barabash, ulitsa Sholom-Aleikhema, 15/2, kv. 34; Petr F. Chernyak, Brest-Litovsky prospekt, 47a, kv. 23; Evgeny I. Frumin, ulitsa Shumskogo, 8, kv. 306; Grigory B. Asoiants, bulvar Lesi Ukrainki, 2, kv. 16, all of Kiev; Vadim A. Kulesha, ulitsa Pushkinskaya, 51a, kv. 25, Beloretsk Bashkirskoi ASSR; Viktor A. Golomazov, ulitsa Lenina, 64, kv. 8, Beloretsk Bashkirskoi ASSR; Dias A. Ibragimov, ulitsa, Fedora Alexeeva, 37, kv. 36, Beloretsk Bashkirskoi ASSR; Nikolai I. Kozhevnikov, ulitsa Khudai Berdina,20o, Beloretsk Bashkirskoi ASSR; Nikolai P. Chernenko, ulitsa Poschinskaya, 13, kv. 31, Orel; Vitaly S. Starchenko, Moskovskoe Shosse, 157, kv. 12, Orel; Alexei S. Kalosha, ulitsa Komsomolskaya, 77, kv. 29, Orel, all, U.S.S.R.

[21] Appl. No.: 868,463

[22] Filed: Jan. 10, 1978

[30] Foreign Application Priority Data

Jan. 21, 1977 [SU] U.S.S.R. ..... 2437802

[51] Int. Cl.[2] ..... B05C 3/15

[52] U.S. Cl. ..... 118/74; 118/402; 118/420; 118/421; 118/428; 118/429; 118/DIG. 19

[58] Field of Search ..... 118/419, 423, 420, 421, 118/429, 402, 403, 428, 74, DIG. 19; 427/311, 312

[56] References Cited

U.S. PATENT DOCUMENTS

| | | | |
|---|---|---|---|
| 1,365,414 | 1/1921 | Kochendorfer | 118/421 X |
| 1,765,743 | 6/1930 | Sommer | 118/420 X |
| 2,751,311 | 6/1956 | Rosseau | 427/311 |
| 3,027,268 | 3/1962 | Linden | 118/429 X |

*Primary Examiner*—John P. McIntosh
*Attorney, Agent, or Firm*—Haseltine, Lake & Waters

[57] ABSTRACT

A tank furnace comprises a first container containing a molten flux and connected with a hoisting mechanism, and a second container containing a molten coating metal. The second container is stationary mounted so as to be placed inside the first container when in its upper position. The mechanism for advancing articles into the coating zone is connected with a device for controlling the depth of immersion of the articles being coated. The first container is fitted with electrodes.

5 Claims, 3 Drawing Figures

TANK FURNACE FOR HOT-DIP METAL COATING

BACKGROUND OF THE INVENTION

Field of the Application

The present invention relates to metallurgical practice, and more particularly to a tank furnace for hot metal coating. For example, the invention is readily adapted for application in the hot-coating of a steel wire or band with copper-base alloys.

As widely employed in the art of hot metal coating the following steps normally include: removing impurities and oxide films from the articles to be coated, submerging said articles in a molten coating metal and subsequently cooling them in the medium preventing the coating from oxidation.

The method described above is performed on any conventional apparatus for hot metal coating, which comprises a container for a molten metal, a means for cleaning articles to be coated before immersion, and a means for protecting the coating against oxidation.

It is now widely accepted practice to use an apparatus for hot-dip metal coating, which incorporates liquid devices intended to clean the articles being coated.

In addition to a container for molten coating metal, the prior-art apparatus comprises a container for a liquid chemical cleaner positioned in front thereof in the direction in which the articles are advanced (cf. Swedish Pat. No. 329068, Cl.48b (08). The apparatus of this type fails to ensure sufficient efficiency of the process because of the necessity to convey articles between the chamber and the container. Moreover, the apparatus is complicated in construction and requires much floor space.

The above disadvantages are not inherent in the apparatus in which a molten flux, having the same temperature as a molten coating metal, is used as a means for cleaning the articles to be coated.

U.S. Pat. No. 2,751,311 describes a tank furnace for metal coating, comprising a stationary body with a chamber containing a molten flux and a container filled with a coating metal. The chamber is fitted with electrodes for melting a flux and maintaining a predetermined temperature.

The furnace of the patent referred to above in provided with a hoisting mechanism which is mechanically linked with the container through a pusher bar pivoted thereto and interacting with a cam mounted on the rod of a fluid actuated cylinder. Thus, the container has two fixed positions in height relative to the furnace chamber. In both positions, upper and lower, the container is found inside the furnace chamber, with the level of molten metal in the container being lower than that of molten flux. The furnace is equipped with a mechanism adapted for advancing work pieces to the coating zone and provided with a cam manipulated by a piston and rod combination actuated by a fluid cylinder. In operation, the suspended articles advance under pusher bar action in the upper part of the furnace chamber above the container. The depth of immersion of the articles being coated is controlled by a means provided in the form of a screw pair driven by a hand wheel and kinematically connected to the hoisting mechanism.

At the initial moment of the furnace operation the container is brought in its lower position so as to enable the work pieces to be advanced thereabove by the feeding mechanism to the position for coating.

Next, the container is raised by the hoisting mechanism until the molten metal dips the work to the predetermined level and time. After the immersion is completed, the container is returned to its initial position.

To compensate for exhaustion of molten metal in the bath, the cam of the hoisting mechanism is carried forward relative to its pusher with the aid of the screw pair of the depth-of-immersion control device, whereas the container is raised to a desired level relative to the work piece being coated. However, notwithstanding high rate of the coating process, the above-described tank furnace sometimes fails to ensure uniformity of the coating chemical composition. The reason for this is a lowering level of molten flux above the bath surface of molten metal in the process of coating due to a higher rate of flux consumption over the consumption rate of molten metal. It has been experimentally found that the chemical composition of the coating based on the alloys composed of several metals depends upon said level value. For example, in hot brassing of a steel work piece, zinc losses in the coating over the losses of the coating metal depend upon level of the molten flux above the bath surface of molten brass.

Therefore, in the furnace of the above-described construction it is possible to maintain the body of molten flux at constant level above the molten metal bath surface by moving the container relative to the furnace chamber with the aid of the hoisting mechanism. This, however, causes the depth of immersion to deviate from a preset value. Using respective control means for readjusting the predetermined depth of immersion will again upset the level of molten flux above the molten metal both surface, since the depth-of-immersion control means is connected with the container through the hoisting mechanism.

In brass coating of continuously advanced flexible lengthy articles, such as wire or band, a drop in the level of the flux body results in the non-uniform chemical composition of the coating, adversely affecting its properties. Any deviation from a predetermined depth of immersion interrupts the time interval required for the immersion of the article being coated beneath the bath of the molten metal. This, in turn, fails to ensure a uniform thickness of the metal coating and impairs its corrosion resistance.

SUMMARY OF THE INVENTION

It is an object of this invention to provide a tank furnace for hot-dip metal coating, which makes possible a separate control of the level of molten flux above the surface of a molten coating metal and of the depth of article immersion beneath the bath of molten coating metal in order to ensure uniform chemical composition and desired properties of the coating.

The object of the invention is attained in a tank furnace for hot-dip metal coating, comprising a stationary body mounting inside a first container fitted with electrodes and containing a molten flux, a second container containing a coating metal and mounted so as to be inside the first container during coating of an article, a hoisting mechanism for displacement of one of said containers relative to the other one, a mechanism for advancing articles to the coating zone, mounted substantially above the second container, and a device for controlling the depth of article immersion, wherein, according to the invention, the hoisting mechanism is mechanically connected with the first container, the second container being rigidly connected to the stationary body, with the depth-of-immersion control device being operably connected to the article advancing mechanism.

The tank furnace construction according to the invention enables separate control of two parameters of the technological process, affecting the quality of the coating, namely, the level of the molten flux body above the surface of a molten coating metal and the depth of the article immersion, which, in the event of coating such articles as wire or band advanced at a definite speed, determines the time of the article immersion in the molten coating metal. The above-mentioned advantages permit the tank furnace to be suitably used, in particular, for brassing which requires the level of flux body to be maintained within a limited range in order to avoid zinc losses.

The hoisting mechanism incorporated in the tank furnace according to the invention is preferably connected with the first container through a vertically movable slide geared to its drive mounted on the furnace stationary body.

To enable accurate control of the molten flux level above the surface of the coating metal, the vertically movable slide of the hoisting mechanism is preferably geared to its drive by means of a screw pair.

To ensure accurate control of the same molten flux level, the vertically movable slide is preferably rigidly connected to the nut of the screw pair and provided with rollers contacting vertical guides of the furnace stationary body.

To simplify the furnace construction, the depth-of-immersion control device is preferably connected to the mechanism for advancing the articles being coated through the intermediary of the latter.

Specifically, in treating flexible lengthy articles, such as wire or band, the mechanism for advancing the articles to be coated is advantageously fitted with guide rollers mounted on both sides of the second container, and the depth-of-immersion control device is formed as a bar cantilevered between the guide rollers so as to control the overhang length and provided with a header contacting the article in a manner to enable a relative displacement of the latter.

BRIEF DESCRIPTION OF THE DRAWINGS

The invention will be further described, by way of example only, with reference to the accompanying drawings, in which.

A preferred embodiment of the invention will now be described as applied for brass coating of articles such as wire, etc.

DESCRIPTION OF THE INVENTION

Figure 1:
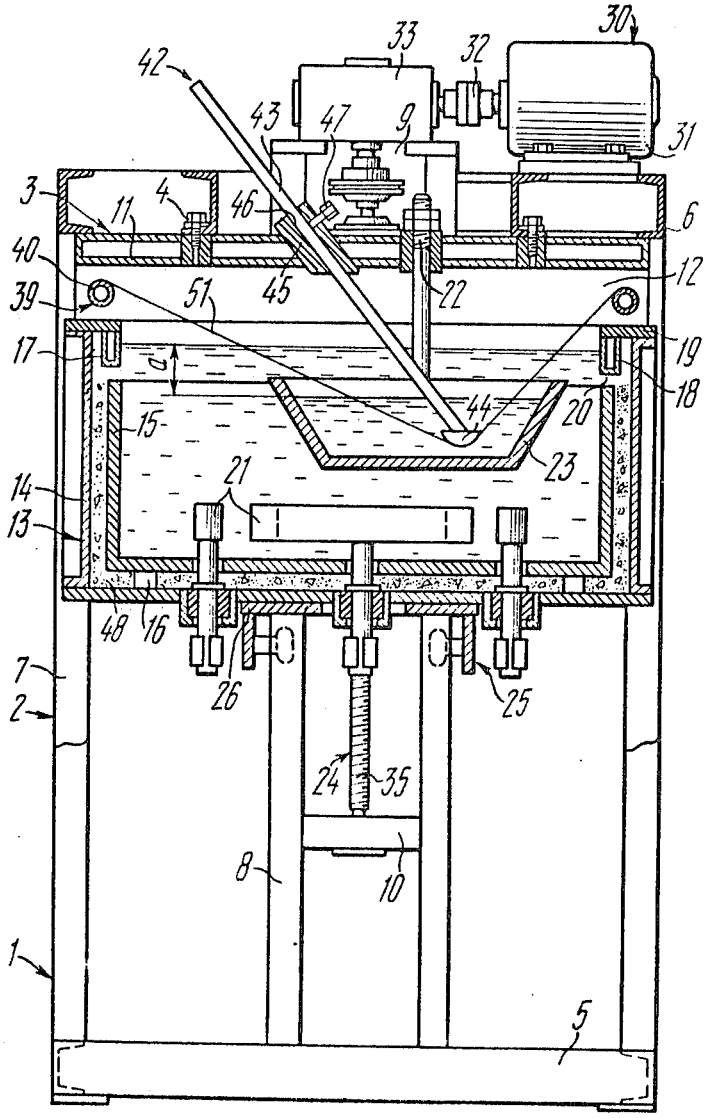
FIG. 1 is a schematic sectional view of a bath-furnace for hot-dip metal coating in accordance with the invention.

Considering now the drawings in detail, the tank furnace of the invention comprises a stationary body 1 (FIG. 1) made up of a base 2 and a cover 3 secured to each other by bolts 4. The base 2 is rectangular in shape and has a bottom frame 5 and a top frame 6, interconnected by four vertical support stands 7. One of the lateral sides of the base 2 is provided with two vertical guides 8 having horizontally extended upper and lower tie rods 9 and 10, whose purpose will become clear from the further description. The vertical guides 8 are of a channel type. The cover 3 of the stationary body 1 is water-cooled and cylindrical in cross-section, having a horizontal shelf 11 (FIGS. 1,2) and vertical shelves 12. The cover is secured to the top frame 6 of the base 2 by the bolts 4.

Movably mounted inside the stationary body 1 is a first container 13 containing a molten flux.

The first container 13 consists of an outer crucible 14 (FIG. 1) and an inner crucible 15 mounted inside the former on legs 16. Formed intermediate respective walls and bottoms of said crucible is a spacing 17 filled with solid flux. The walls of the outer crucible 14 are water-cooled (not shown). The upper edge of the inner crucible 15 is disposed lower than the upper edge of the crucible 14. Arranged in the interspace between said edges is a water-cooled shoulder 18 secured to the outer crucible 14 by a flange 19 so that a small slot 20 is formed between the shoulder and the upper edge of the inner crucible 15. The water-cooled shoulder 18 is adapted to protect the upper edge of the inner crucible 15 from melting down. Arranged at the bottom part of the inner crucible 15 are three electrodes extending outwards through the holes formed in the bottoms of the both crucibles.

The second container 23 is fixed on the under side of the horizontal shelf 11 of the cover 3 by means of struts 22. The second container 23 is considerably smaller in size than the first container 13 and is mounted so as to form a spacing between the walls of the second vessel 23 and the walls of the inner crucible 15 of the first container when both containers are brought in alignment over the height thereof. The second container 23 is adapted to contain a molten coating metal.

The tank furnace according to the invention is equipped with a hoisting mechanism connected with the first container 13 through a vertically movable slide 25. The slide 25 comprises a supporting tray 26, with the container 13 being mounted on the top surface thereof, and a guide tray 27 (FIG. 2) forming a right angle with the supporting tray 26 and directed upward. Four pairs of rollers 29 are mounted for rotation on axles 28 (FIGS. 2,3) of the guide tray 27 of the vertically movable slide 25. The rollers are in contact with the inner and outer surfaces of the channels used as the vertical guides 8 of the stationary body.

The hoisting mechanism 24 (FIG. 1) is equipped with a drive 30 which comprises an electric motor 31 connected to a reduction gear 33 by means of a clutch 32. The electric motor 31 and the reduction gear 33 are fixedly mounted on the top frame 6 of the base 2.

Figure 2:
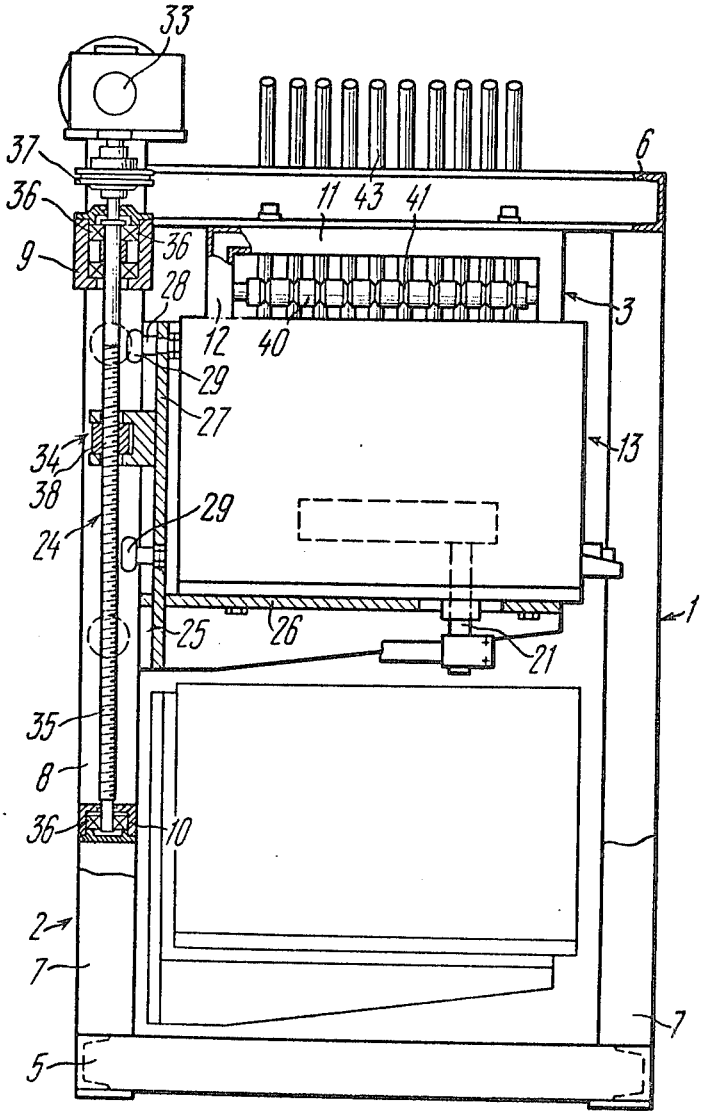
FIG. 2 is a side elevation with a partial section of same.
Figure 3:
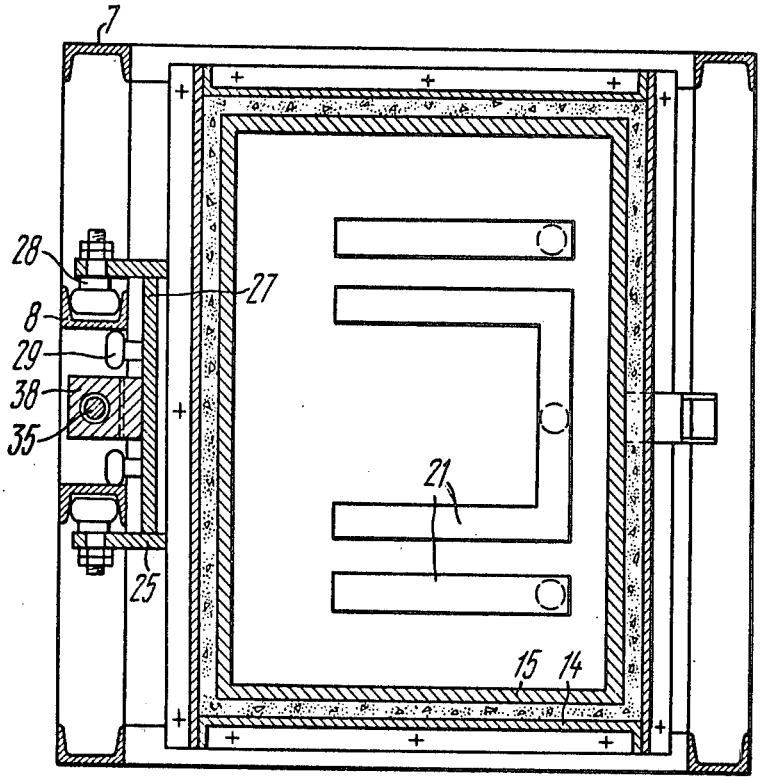
FIG. 3 is a cross-section taken along line III—III of FIG. 2.

The vertically movable slide 25 is geared to the reduction gear 33 of the drive 30 by means of a screw pair 34 (FIG. 2) which includes a screw 35 mounted in bearings 36 received in the holes of the tie rods 9 and 10 of the base 2. The screw 35 is connected to the output shaft of the reduction gear 33 by means of a coupling 37. In addition, the screw pair 34 includes a nut 38 rigidly connected to the slide 25 (FIGS. 2,3).

The hoisting mechanism 24 may be variously otherwise embodied though the embodiment thereof described above is preferable due to reliability and simplicity of its design. It is apparent than any other conventional mechanism with controlled rate of travel may be used, for example, a pneumatic hoisting mechanism.

The tank furnace according to the invention is equipped with a mechanism 39 for advancing articles to the coating zone. In the appended drawing there is shown a portion of said mechanism, located directly inside the furnace. To facilitate the advancing of flexible lengthy articles, the mechanism in question is formed with rollers 40 arranged or located on both sides of the second container 23 and mounted in bearings (not shown) of the vertical shelves 12 of the cover 3. The guide rollers 40 are provided with grooves 41, the number of which corresponds to the number of wires simultaneously advanced to the coating zone.

The device 42 according to the invention for controlling the depth of immersion of each of said wire (FIG. 1) comprises a bar 43 fitted with a header 44. To mount the bars 43, corresponding in number to the number of simultaneously treated wires, the cover 3 is provided with a boss 45 with inclined holes 46 and stop screws 47 mounted perpendicularly to the axes of the inclined holes 46. The bars 43 are cantilevered in the holes of the boss 45 so as to be axially displaced and fixed in position, thus providing for the overhang length control of the bars.

In preparing the tank furnace of the invention for operation, the first container 13 (FIGS. 1,2) and the vertically movable slide 25 are brought to lowermost position with the aid of the screw pair 34 (FIG. 2).

The spacing 17 between the outer crucible 14 and the inner crucible 15 is filled with a finely divided solid flux 48. For example, in brassing a steel wire the following flux composition was used: boric anhydride, 69%; sodium oxide, 22%; and potassium photozirconate, 9%. The flux of similar composition is thereafter melted down inside the crucible 15 which is used as the furnace working space. To melt down the solid flux, any conventional heater, placed in the bottom portion of the crucible is used at the initial stage of operation; and then electrodes 21 are applied as soon as the first layers of flux melt down. A flux melt 50 is brought to the level higher than the lower edge of the water-cooled shoulder 18. A part of molten flux drains through the slot 20 into the spacing 17 between the walls of the crucible. Thus, the walls of the inner crucible 15 are completely immersed in the molten flux preventing them from oxidation. On the other hand, the flux solid particles in the spacing 17, having a low heat conduction, are used for heat insulation.

The hoisting mechanism 24 is operated to raise the first container 13 until the second container with a coating metal is immersed in the flux melt 49. The coating metal is melted and heated to a temperature of the molten flux, whereupon the first container 13 is positioned with the aid of the screw pair 34 relative to the second container 23 so that the height "a" of the molten flux level 49 above the surface of the coating metal melt (or, in other words, the difference between the levels of the melts 49 and 50) is an optimal value catering for an article of the predetermined type and size, and for a coating of the predetermined chemical composition. For a steel wire of 0.8 mm in diameter and brass coating 62 with zinc content in the melt 50 of about 35%, the height "a" is to be within the range of from 80 to 86 mm., with zinc losses in the process of coating at a temperature of 1,000° not exceeding 0.5%. Greater values of "a" are undesirable since enormous stresses tend to develop in the wire, which may cause its rupture. Smaller values of "a" will lead to an increase in zinc losses. For example, when values "a" are from 45 to 50 mm, zinc losses will be from 1.9 to 2.2%, and if the height "a" is lowered to 20 mm, the losses will increase to 3%.

Bobbins with coiled wire are set into an unwind reel (not shown) of the article advancing mechanism. Each wire 51 is passed through the grooves 41 of the guide rollers 40, with the bars 43 being preliminary drawn off to upper position. Then, by lowering the bars 43 each wire 51 is dipped in the melt 49 to a predetermined depth which depends on the wire feed rate and predetermined duration of the article immersion in the melt 50 of the coating metal. After the bars 43 are fixed in position by means of the stop nuts 47, the drive (not shown) of the advancing mechanism 39 is operated.

From the first guide roller 40 the wire 51 first enters into the flux melt 49 where its surface is cleaned of dirt and oxide film, and preheated. When immersed in the melt 50 of the coating metal, the wire 51 is heated to a temperature of the metal (equal to the flux temperature) and is then coated with a film of the coating metal, whereupon it renters into the flux melt 49 to be coated with the flux film preventing the coating metal against oxidation during subsequent cooling.

After the wire 51 is cooled, the flux film crumbles when passing through bending rolls (not shown) mounted outside the furnace.

During the coating process the levels of the melts 49 and 50 drop at different speeds, with the level of flux dropping quicker since it is carried away by the wire in the form of film several times thicker than the coating applied to said wire which is due to different viscosity of said liquid media. As a result, the level of the molten flux above the surface of the molten coating metal diminishes, thereby failing to ensure uniform chemical composition of the coating, as has been already stated above. Thus, in the case of brassing a steel wire used as a semi-finished product in manufacturing metallic cord for automobile tyres, even a small decrease in zinc content in the brass coating will impair its adhesion properties relative to the rubber. Therefore, the height "a" of the molten flux level above the surface of the molten metal is regulated during the process of coating the first container 13 with the aid of the screw pair 34 of the hoisting mechanism 24. This displacement in no way affects the depth of immersion of the wire 51 in the metal melt 50. To compensate for the exhaustion of metal in the second container 23, the bars 43 of the depth-of-immersion control device 42 are brought down.

Thus, the tank furnace according to invention makes it possible to obtain coatings with stable pre-determined properties, which renders the furnace especially suitable in hot-dip coating of metals by copper-base alloys, this being far more economical method than the galvanizing method now in use.

While particular embodiments of the invention have been shown and described, various modifications thereof will be apparent to those skilled in the art and the departures may be made therefrom within the spirit and scope of the invention as defined in the claims.

What is claimed is:

1. A tank furnance for hot metal coating, comprising: a stationary body; a first container mounted inside said body containing a molten flux; electrodes mounted in said first container; a second container containing a molten coating metal being rigidly connected to said stationary body for positioning inside said first container and forming a coating zone in the course of applying a coating to an article; hoisting means mechanically connected to said first container; advancing means for advancing articles to the coating zone mounted substantially above said second container, said advancing means having guide rollers mounted at the sides of said second container, and control means for controlling the depth of immersion of the articles to be coated, said control means being formed with cantilevered bar means and header means between said guide rollers for guiding said articles being coated through grooves in said rollers for advancing coated articles.

2. A tank furnace as claimed in claim 1, in which said hoisting means is fitted with a drive mounted on said stationary body and a vertically movable slide geared to said drive and mounting said first container.

3. A tank furnace as claimed in claim 2, in which said hoisting means comprises a screw pair geared to said drive and to said vertically movable slide.

4. A tank furnace as claimed in claim 3, in which said screw pair includes a nut rigidly connected to said vertically movable slide fitted with rollers and said stationary body having vertical guides brought in contact with said rollers.

5. A tank furnace as claimed in claim 1, employed to treat flexible lengthy articles such as, wire or band, wherein: said depth-of-immersion control means is provided with means for axial adjustment.

* * * * *